United States Patent [19]

Sizer

[11] 4,108,257

[45] Aug. 22, 1978

[54] APPARATUS FOR CONTROLLING A WELL DURING DRILLING OPERATIONS

[75] Inventor: Phillip S. Sizer, Dallas, Tex.

[73] Assignee: Otis Engineering Corporation, Houston, Tex.

[21] Appl. No.: 833,012

[22] Filed: Sep. 14, 1977

Related U.S. Application Data

[62] Division of Ser. No. 634,824, Nov. 24, 1978.

[51] Int. Cl.[2] ..... E21B 23/04; E21B 33/127; E21B 33/129

[52] U.S. Cl. ..... 175/230; 166/122; 166/129; 166/154; 166/183; 166/188; 175/325

[58] Field of Search ..... 166/122, 51, 129, 278, 166/133, 120, 153, 154, 156, 183, 187, 188, 244 R, 315; 175/65, 233, 325

[56] References Cited

U.S. PATENT DOCUMENTS

| | | | |
|---|---|---|---|
| 2,978,046 | 4/1961 | True | 175/233 |
| 3,134,439 | 5/1964 | Shields, Jr. | 166/51 |
| 3,190,359 | 6/1965 | Brown | 166/122 |
| 3,299,955 | 1/1967 | Page, Jr. | 166/129 X |
| 3,373,820 | 3/1968 | Robinson, Jr. et al. | 166/187 |
| 3,503,445 | 3/1970 | Cochrum et al. | 166/244 R |
| 3,527,296 | 9/1970 | Malone | 166/122 |
| 3,606,924 | 9/1971 | Malone | 175/230 X |
| 3,710,862 | 1/1973 | Young et al. | 166/278 |

*Primary Examiner*—Stephen J. Novosad
*Attorney, Agent, or Firm*—Vinson & Elkins

[57] ABSTRACT

A method and apparatus for use in controlling a well during drilling operations is disclosed. The method includes actuating a downhole packer and providing for flow in a controlled manner past the packer. The apparatus includes a packer and means for controlling flow past the packer. This abstract is neither intended to define the scope of the invention which, of course, is defined in the claims, nor is it intended to be limiting in anyway.

26 Claims, 12 Drawing Figures

APPARATUS FOR CONTROLLING A WELL DURING DRILLING OPERATIONS

CROSS-REFERENCE TO RELATED APPLICATIONS

This application is a division of copending application Ser. No. 634,824 filed Nov. 24, 1975.

BACKGROUND OF THE INVENTION

A. Field of the Invention

This invention relates to an apparatus and method for controlling a well during drilling and more particularly is directed to an apparatus and method for controlling formation conditions encountered during drilling operations.

B. The Prior Art

Occasionally during drilling operations the well is drilled into a formation having an abnormally high gas pressure. Either a gas formation or a gas-liquid formation may be encountered. Such formations may produce blowout conditions, and, unless quickly remedied, the well can get out of control causing a loss of well fluids and destruction of drilling equipment.

Conventional drilling equipment includes a plurality of blowout preventors in a blowout preventor stack. However, surface blowout preventors do not control a well at the source of the problem, namely downhole at the high pressure formation region. Surface blowout preventors can only attempt to confine the high pressure within the well. They are not entirely successful. When a gas bubble makes its way up through the annulus between the drill string and the well, the well may be in danger. A gas bubble high in the annulus means that the hydrostatic head of drilling fluid has become ineffective and the surface casing and equipment may not be able to withstand the high pressure gas to confine the same. Additionally, the gas bubble itself may deteriorate the rams of the blowout preventor to an extent which renders them ineffective.

Attempts have been made to provide a downhole blowout preventor and a method of controlling a well utilizing the same. These attempts have produced systems which still have disadvantages.

U.S. Pat. Nos. 3,283,823 and 3,322,215 to Warrington disclose, respectively, an apparatus and method for controlling downhole formation pressures. These patents disclose utilizing an open bore packer located in the drill string immediately above the drill bit to close the annulus of the well. Another closure means is provided to close the drill string bore at the packer. Communication is then provided from the drill string bore above the packer to the annulus above the packer. Since the hydrostatic head of pressure provided by circulating drilling fluid is ineffective below the packer, the packer must be located directly above the drill bit. Locating the packer directly above the drill bit means that the packer must seal the open bore of the well. In soft sedimentary formations sealing the open bore of the well is difficult and may be impossible.

U.S. Pat. No. 3,427,651 to Bielstein et al also discloses utilizing a packer positioned in the drill string immediately above the drill bit to close the annulus of the well. A communicating means to permit drilling fluid to circulate from the bore of the drill string to the annulus above the packer is provided, although the bore remains open. Such a device still has the disadvantage that it requires the use of an open bore packer.

U.S. Pat. No. 3,503,445 to Cochrum et al also discloses the utilization of an open bore packer to seal the annulus between the drill string and the well wall. A control plug, which is transmitted downward through the drill string, shifts a sleeve valve so that the packer may be inflated and so that communication may be established between the drill string bore and the annulus. The plug also closes the bore. Again, the disclosed system contains the two disadvantages of requiring an open bore packer which may not be able to seal the annulus in a soft formation and of preventing continued circulation of drilling fluid below the packer.

U.S. Pat. No. 3,710,862 to Young et al does disclose a packer and crossover valve combination utilized for completing a well. The patent discloses circulating fluid down an operating string above the packer, through a service seal unit, and out into the annulus below the packer. This operation is carried out after the well has been drilled and the drill string removed. Fluids may then continue to circulate by flowing from a point below the packer up through the annulus of the service seal unit and out into the annulus around the operating string above the packer. Such a packer and crossover combination is not concerned with controlling high formation pressures that may be encountered during drilling operations and, indeed, is operated to stimulate wells having low formation pressures.

U.S. Pat. No. 3,527,296 to Malone teaches packing off a drill string in the cased area of a well, but does not provide for circulation to permit treatment of a well.

While the prior art has recognized that the entire well should be treated (the open hole packers are positioned close to the drill bit) they do no teach a system for treating the entire column of mud in a well in which an open hole packer is ineffective.

OBJECTS OF THE INVENTION

It is an object of this invention to provide a method and apparatus for protecting wells being drilled in which the casing-drill string annulus adjacent the surface is protected from the formation at the bottom of the well and the entire column of mud in the well may be treated even when the well is being drilled through a soft formation in which an open hole packer is ineffective.

Another object is to provide a method and apparatus for protecting wells being drilled in which the entire column of mud in the well may be treated even when the well is being drilled through a soft formation in which an open hole packer is ineffective.

Another object is to protect a well being drilled by providing a method and apparatus for isolating the casing-drill string annulus at the surface from the formation being penetrated while permitting circulation through the entire well bore and drill string.

Another object is to provide a method and apparatus for protecting wells being drilled in which packer-fluid control assemblies located at spaced positions along the drill string may be selectively operated so that an assembly within the cased portion of the well may be operated to insure proper packer operation and a circulation path may be established in which formation pressure fluid will flow to the surface through the drill string where it may be more easily controlled.

It is another object of this invention to provide a downhole blowout preventer including a packer to seal the annulus and a packer by-pass fluid control system to confine high pressure gas to the drill string at the surface where the pressure may be more easily controlled.

It is a further object of this invention to provide a downhole blowout preventer including a packer to seal the annulus and a crossover or by-pass and check valve which enables continued fluid circulation below the packer so that the high formation pressure may be offset by a hydrostatic head of circulating fluid while protecting the annulus above the packer from formation gas.

A further object of this invention is to provide a downhole blowout preventer that can be effectively used in the casing by having a packer to seal the annulus between the drill string and the casing and a crossover or by-pass and check valve to permit continued fluid circulation below the packer while isolating the casing-drill string annulus at the surface from the formation being penetrated.

An additional object of this invention is to provide a method of controlling high pressure formations encountered during drilling which transfers the high formation pressure from the annulus of the well at the surface to the drill string bore during an emergency.

A still further object of this invention is to provide a method of controlling a high pressure formation encountered during drilling operations which seals the annulus between the drill string and the well but permits continued fluid circulation below the sealed location and reverse circulation above the location.

These and other objects, features and advantage of this invention will become apparent from the drawings, the detailed description, and the appended claims.

BRIEF DESCRIPTION OF THE DRAWINGS

In the drawings wherein like numerals indicate like parts, and wherein illustrative embodiments of this invention are shown.

DESCRIPTION OF THE PREFERRED EMBODIMENTS

The well control apparatus and method of this invention is designed to be employed to control high formation pressures and particularly gas or gas-liquid mixtures that may be encountered during the drilling of a well.

Figure 1:
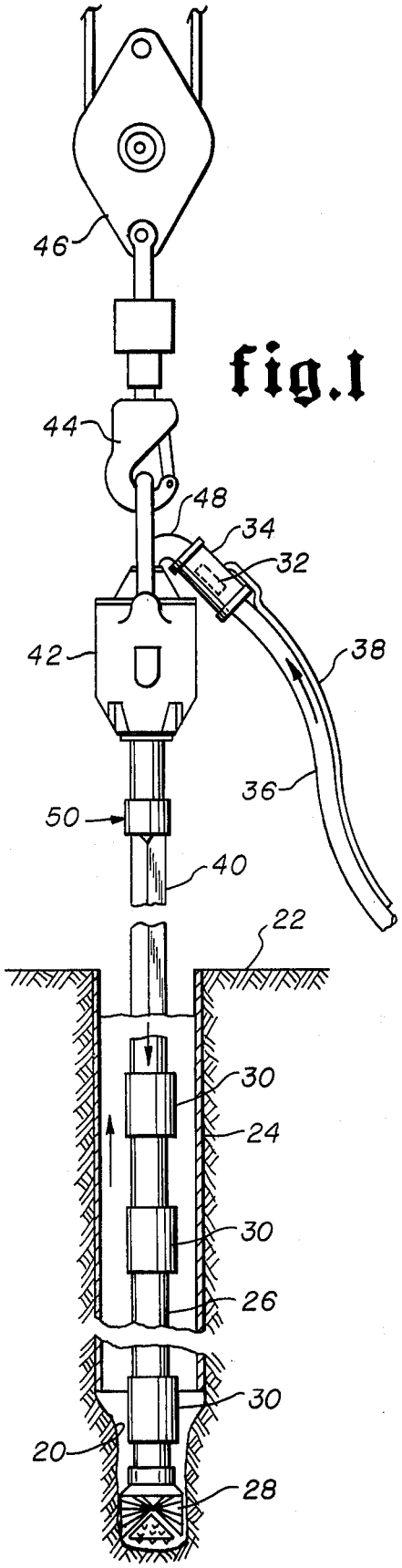
FIG. 1 is a schematic view showing a well during drilling operations.

FIG. 1 illustrates some of the components that would be utilized during well drilling operations.

The well bore 20 is drilled from surface 22, which may be either at the surface of the earth or on the ocean floor.

As the well bore progresses one or more casing strings will be set as illustrated by casing 24.

Through the casing 24 extends the usual drill string 26 with a drill bit 28 on the lower end thereof.

Circulating drilling fluid (the direction of flow of which is shown by the arrows) flows downwardly through the drill string 26 out through the drill bit 28, and upwardly through the annulus between the drill string 26 and the well wall 20 (generally considered the normal circulation). The circulating drilling fluid is able to control normal formation pressures encountered during drilling operations since the pressure due to the hydrostatic head of circulating drilling mud generally exceeds bottom hole pressure.

In accordance with this invention one or more packer-fluid-control assemblies indicated schematically at 30 in FIG. 1 are provided. These assemblies 30, when activated, seal the annulus between the well wall 20 or casing 24 and the drill string 26. They also provide for controlled flow of fluid by-passing the assembly 30 at this point.

In practicing the method of this invention a selected assembly 30 is activated when an abnormal situation, such as a high pressure gas formation, is encountered. By sealing the well-drill string annulus and controlling circulation, the annulus above the selected assembly 30 is protected. A bubble of gas cannot rise in the annulus above the assembly and exert high pressure on the casing head and surface blow-out preventer (not shown).

The assemblies 30 are positioned in the drill string 26 so that packer means, associated with an assembly 30, will effectively seal the annulus around the drill string 26. Since the packer means may not hold in a loose, soft, or relatively friable formation such as unconsolidated sands below the casing 24, the assembly 30 is preferably located in the casing 24 so that the packer means seals against the casing 24. A plurality of assemblies 30 may be spaced along the drill string 26 so that an assembly 30 within the casing 24 will always be available.

One packer means associated with the assembly 30 is activated, controlled circulation by-passing the packer means is established. Normal circulation down the drill string 26 is reversed, and mud is pumped down the annulus to the activated assembly 30 (reverse circulation). The mud circulates through the assembly 30 by-passing the packer means and continues circulating downwardly around the drill bit 28 and back up to the assembly 30. From the assembly 30, the mud returns to the surface through the drill string 26. Preferably the assembly 30 also prevents backflow up the annulus to assure that high pressure gas cannot flow into the annulus above the assembly 30 after the assembly 30 has been activated. Including means to prevent backflow up the annulus, such as a check valve is of particular value when circulation is stopped for any reason. With such a check valve, continued circulation will remove any gas that may be in the annulus above the assembly 30. Gas from the formation will be confined to the drill string 26 above the assembly 30.

Gas confined within the drill string 26 may more safely and readily be controlled while mud is being conditioned or other steps to control the well are being carried out than if the gas was permitted to rise in the annulus above the assembly 30. The increased safety and controlability result because the casing 24 is not designed to withstand a high differential pressure that would be created by high pressure gas while the drill string is. As is well known, the casing 24 is a large diameter, thin walled pipe, and the external pressure of the upper portion of the casing is atmospheric. The upper portion of the casing will, therefore, be unable to offset appreciable internal pressure. On the other hand, the drill string 26 has a small diameter and is of a strength capable of withstanding high internal pressure. In addition, circulating mud surrounding the drill string 26 provides support for the drill string 26.

Means are provided to actuate the packer means associated with the assembly 30, and additionally means are provided to permit controlled circulation of fluid through the assembly 30 by-passing the actuated packer means.

The packer actuating means may be an actuating tool means 32 positioned to be launchable into the drill string 26 so that it may be transmitted downwardly through the drill string 26 when a high gas pressure formation is encountered. One such launching position for the actuating tool means 32 is illustrated schematically in FIG. 1. The tool 32 is positioned within a bypass nipple tool launcher 34 forming a portion of the hose 36 through which drilling fluid passes. A control line 38 provides a means for controllably launching the tool 32 into the stream of drilling fluid.

Conventional well equipment illustrated in FIG. 1 includes a Kelly 40 for transmitting torque to the drill string 26; a swivel joint 42, for rotatably supporting the Kelly 40; a hook 44 and traveling block 46 for raising and lowering the Kelly 40 and a flexible hose 36 with a gooseneck 48 for providing a conduit means to inject the drilling fluid into the swivel joint 42.

To assist in controlling an abnormally high formation pressure a valve 50 may be provided at the upper end of the Kelly 40.

Figure 2:
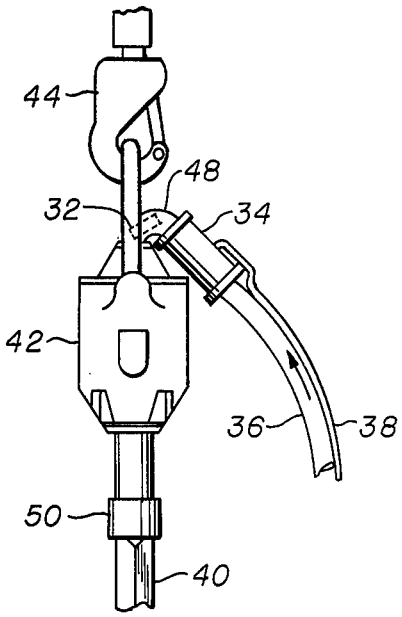
FIG. 2 is a view in elevation showing a tool being launched into the well.

As seen in FIG. 2, the actuating tool means 32 is launched into the stream of drilling fluid after the well has been drilled into an abnormally high formation pressure region and it is desired to control the well. Circulating drilling fluid transmits the tool 32 downwardly through the drill string 26.

The tool 32 is transmitted downwardly until it comes to the assembly 30.

Figure 3:
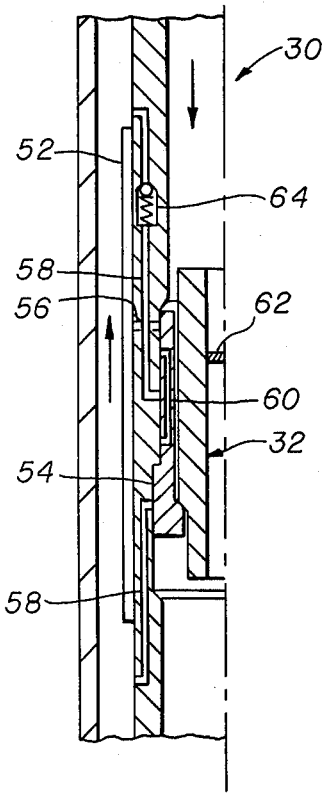
FIG. 3 is a schematic view in section showing the tool engaging a mandrel in a well.
Figure 4:
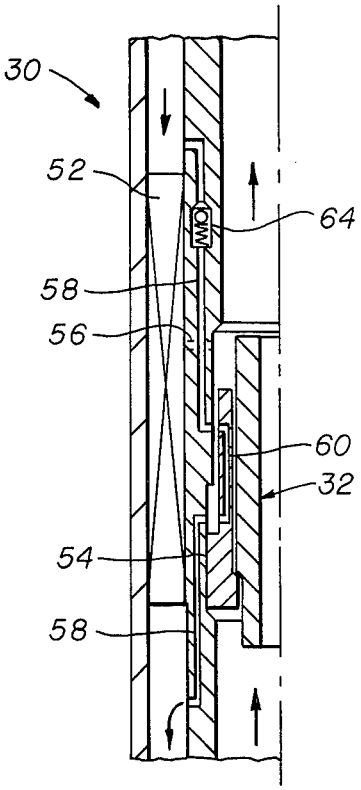
FIG. 4 is a schematic view in section showing the tool after having actuated packer means carried by the mandrel.

FIGS. 3 and 4 illustrate schematically the method and one embodiment of an assembly 30 which is activated by tool 32 in accordance with this invention to control the high pressure gas formation. In FIG. 3 the actuating tool means 32 has just landed in the assembly 30. Packer means 52, associated with assembly 30, is collapsed and sleeve valve means 54 prevents flow thourgh port 56 and communicating means 58. Continued circulation moves sleeve valve means 54 to the FIG. 4 position exposing port 56 to permit inflation of the packer means and aligning by-pass passageway 60 of sleeve 54 with communicating means 58. The packer means 52 is inflated to a predetermined pressure when the frangible disc 62 across the bore through tool 32 is ruptured. Upon rupture of the disc 62, circulation is reversed, as indicated by the arrows in FIG. 4, to introduce newly conditioned mud into the annulus above the assembly, thereby replacing gas or gas-cut mud in the annulus and relieving the annulus from gas pressure. When the backflow-check valve 64 is employed, the annulus may first be opened at the surface to relieve gas pressure in the annulus, if desired, because the check valve 64 will prevent additional gas pressure from being introduced into the annulus while circulation is being reversed or while other procedures are carried out at the surface during which circulation is stopped. Utilizing the system described high formation pressure is confined by the packer means 52 to the annulus below the packer means 52 and, drilling fluid circulation is controlled by valve assembly means to provide for return flow up the interior of the drill string 26 above the packer means 50.

Figure 5A:
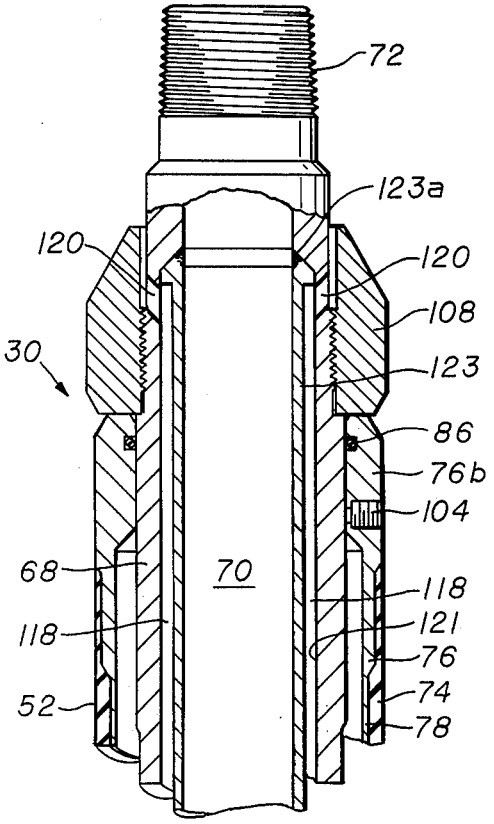
FIGS. 5*a* and 5*b* are continuation cross-sectional views of a mandrel having packer means and valve assembly portions which may be employed as a portion of the blowout preventor system.
Figure 5B:
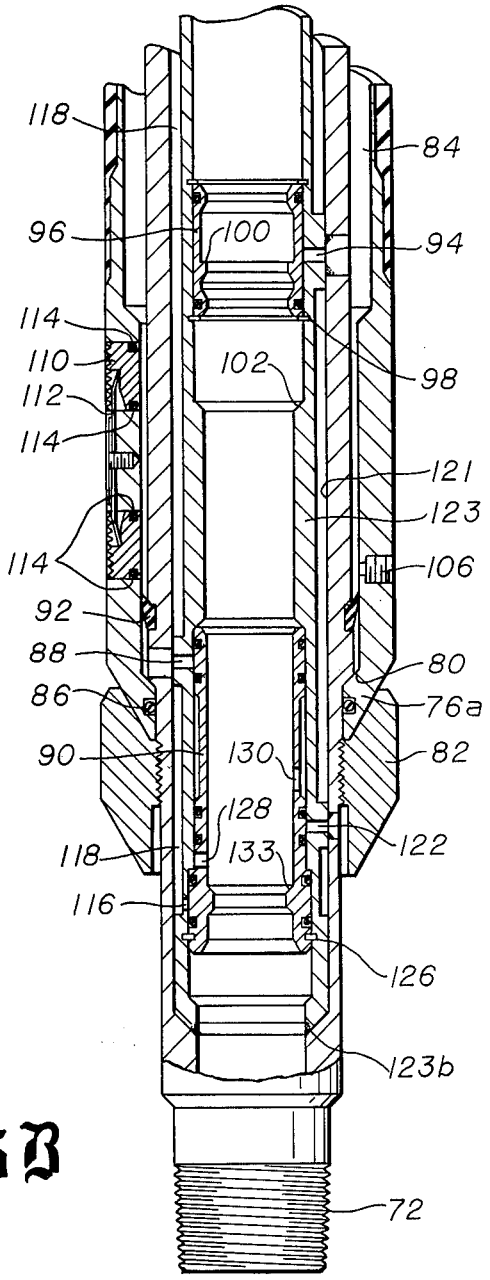

FIGS. 5*a* and 5*b* show an alterantive assembly 30 with the associated packer means 52 and a portion of the valve assembly means. The assembly 30 includes tubular mandrel means 68 having a bore 70 therethrough and threads 72 at either end for connection with the drill string 26. The bore 70 of the mandrel means 68 is of substantially the same size as the bore of the drill string 26.

Carried by the mandrel means 68 is a packer means 52 to seal with the wall of the well. The illustrated packer mens 52 is an inflatable sleeve type packer.

The packer means 52 includes a resilient elastomeric packer element 74 mounted around a packer sleeve 76.

The packer element 74 may be any suitable resilient elastomeric packer material that will provide an effective seal. The packer element 74 is preferably designed to seal against the well casing 24 but if the only assembly 30 available is in the open hole the packer element 64 may seal in the open hole, or if feasible, the drill string 26 may be lifted until the assembly 30 is disposed within the casing 24.

The sleeve 76 surrounds the tubular member 68. The packer material 74 is bonded to the exterior annular surface of the sleeve 76. The sleeve 76 has a reduced thickness midsection 78. The reduced midsection 78 can be inflated and expanded so that the packer element 74 engages the bore wall of the casing 24. To maintain the sleeve 76 in position around the tubular member 68 the lower end of the sleeve 76*a* is confined between a downward facing shoulder 80 of the tubular member 68 and collar 82. To permit the packer means to be inflated and expanded into its sealing position, the upper end 76*b* of the sleeve 66 is slidable along the tubular mandral means 68.

The packer means 52 is inflated by injecting fluid into the annulus 84 between the packer sleeve 76 and the tubular mandrel means 68. To prevent the injected fluid from leaking out of the annulus 84, seals 86 are provided at the upper 76*b* and lower 76*a* ends of the sleeve 76 between the sleeve 76 and tubular mandrel means 68. A fluid injection port 88 communicates the bore 70 of the tubular mandrel means 68 with the annulus 84. Injection of fluids through port 88 is controlled by valve means 90. Annular check valve means 92 prevent backflow of the injected, inflating fluid.

To deflate the packer, a deflation port 94 communicates between the bore 70 of the tubular member 68 and the annulus 84. A sleeve valve means 96 controls this deflation port 94. The sleeve valve means 96 initially closes the deflation port 94. The sleeve valve means 96 is releasably maintained in this closing position by a shear ring 98. The sleeve valve means 96 has appropriate internal recesses 100 to engage a work tool lowerable through the drill string. When it is desired to deflate the packer, a work tool is transmitted downwardly through the drill string until it engages the recesses 100 of the sleeve valve means 96. Continued downward movement of the work tool shears the shear ring 98 and shifts the sleeve valve means 96 downwardly until it engages shoulder 102. When the sleeve valve means 96 is in this lower position, the deflation port 94 provides for fluid communication from the annulus 84 to the bore 70 and permits fluid to drain out from the annulus 84 into the bore 70.

To prevent the packer sleeve 76 from collapsing around the tubular mandrel means 68 when the assembly 30 is being lowered through the well, fluid is disposed within the annulus 84 between the sleeve 76 and the mandrel means 68 prior to positioning the assembly 30 in the drill string 26. An upper 104 and lower 106 aperture are provided to permit the annulus to be filled with an incompressible liquid. Plugs are insertable within the apertures. To fill the annulus 84 with a liquid, the plugs are removed and the liquid is pumped into the annulus 84 through the lower aperture 106. When the liquid flows out of the upper aperture 104 the annulus 84 is full. The plugs are then inserted in the apertures to confine the liquid.

To prevent the packer means 52 from coming in contact with the casing or well wall and tearing up the resilient packing element 74, enlarged wear ring collars 82 and 108 are positioned at either end of the packer sleeve 76 on the tubular mandrel means 68. The outer annuluar surfaces of the collars 82 and 108 extend beyond the outer surface of the packer element 74. Thus, when the assembly 30 is being lowered through the well as part of the drill string 26, the wear ring collars 82 and 108 engage the well wall and protect the packer element 74.

Preferably, to prevent the packer means 52 from shifting, buttons 110 are provided. The buttons 110 expand outwardly and grip the wall of the well when fluid is injected into the annulus 84 to actuate the packer means 52. The buttons 110 are normally held in a retracted position by spring 112. Preferably less force is required to push the buttons 110 outward against the spring 112 than is required to expand the packer sleeve 76 so that the buttons are expanded into a gripping engagement with the well wall before the packer sleeve 76 is expanded. Fluid is prevented from escaping around the buttons by seals 114.

Figure 11:
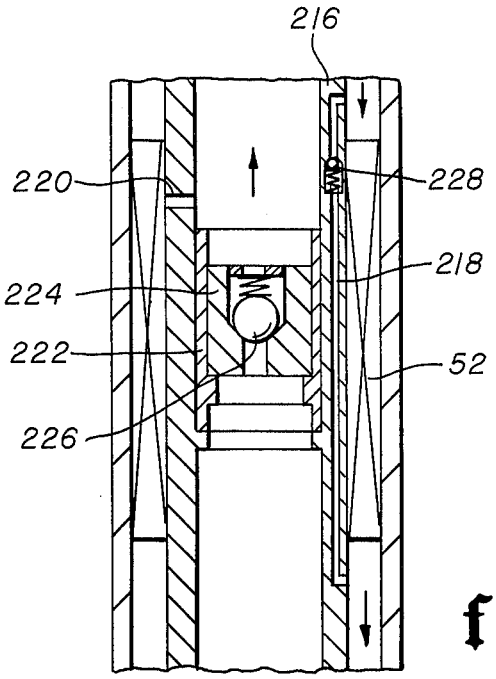
FIG. 11 is a schematic view of an alternative mandrel having packer means and by-pass communicating means.
Figure 6:
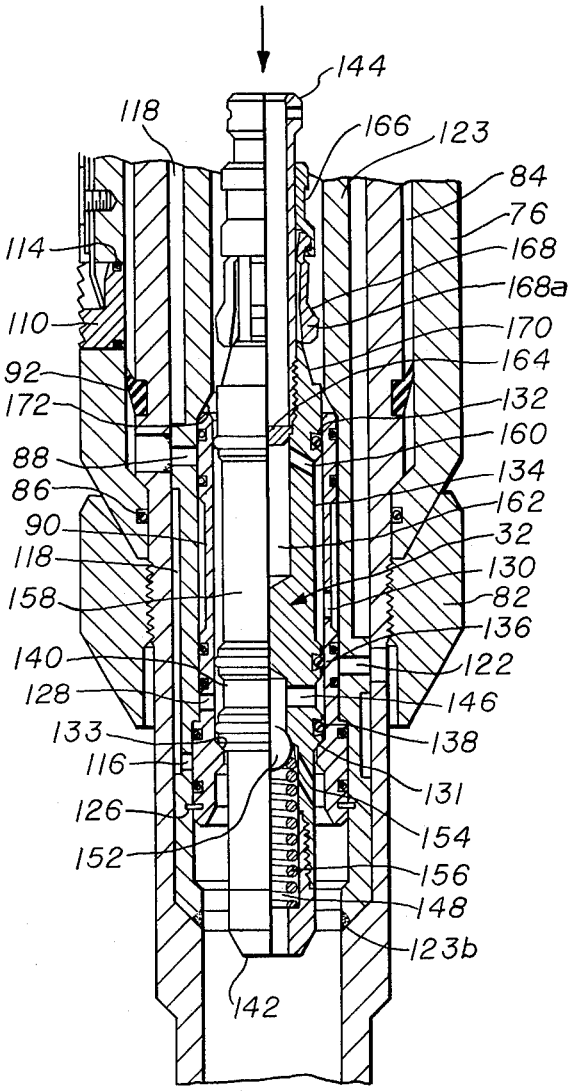
FIG. 6 is a view partly in section and partly in elevation showing the tool engaging the mandrel of FIG. 5.
Figure 7:
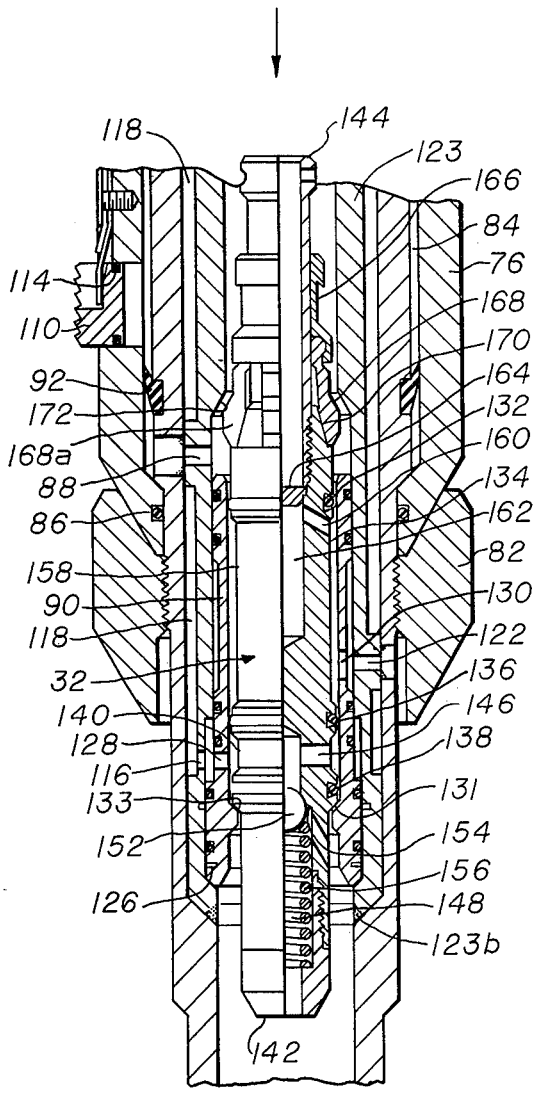
FIG. 7 is a view partly in section and partly in elevation showing the tool of FIG. 6 in the packer actuating and valve controlling position.

The assembly 30 also includes portions of a valve assembly means to provide for controlled circulation by-passing the packer means 52. The valve assembly means permits continued circulation of drilling fluid below the actuated packer means 52 and provides for return of fluid within the drill string 26 above the packer means 52. Preferbly, the valve assembly means also includes means for preventing fluid and gas pressure from flowing into the annulus above the actuated packer means 52. As illustrated in FIGS. 3, 4, and 11, the controlled circulation by-passing the actuated packer means 52 may be parallel circulation down the annulus to the activated assembly 30, through the assembly 30 by-passing the actuated packer means 52, continuing down the annulus, through the drill bit 28, and back up the drill string 26. Preferrably, however, as illustrated in FIGS. 5,6, and 7 the assembly 30 is designed so that the controlled circulation is cross-over circulation so that upon reverse circulation fluid circulates down the annulus above the packer means, crosses over at the assembly, continues downwardly in the drill string below the packer means, flows through the drill bit, and returns by flowing up the annulus below the packer means, crosses over at the assembly 30, and continues upward to the surface in the drill string 20 above the packer means. Controlled crossover circulation is preferred because upon reverse circulation, with cross-over circulation, any cuttings in the open hole are not forced through ports in the drill bit 28. With controlled parallel circulation, upon reverse circulation, such cuttings may be forced into ports in the drill bit 28 causing blockage of the ports and inhibiting further circulation.

FIGS. 5A and 5B illustrate portions of a crossover valve assembly means formed within assembly 30. These portions include communicating means and valve means.

Two sets of cummunicating means are provided. Both communicate between the interior bore 70 of the tubular mandrel means 68 and the exterior of tubular mandrel means 68 at exterior ports on opposite sides of the packer means 52. A first set of communicating means communicates from the bore 70 at port 116 through means 118 of the tubular mandrel means 68 to ports 120 above the packer means 52. A second set of communicating means communicates from the bore 70 at port 122 through the tubular mandrel means 68 to a point below the packer means 52.

One manner of providing communicating means to communicate between the bore 70 of the tubular mandrel means 68 and the exterior of the tubular mandrel means at ports on opposite sides of the packer means 52, as illustrated in FIGS. 5A and 5B, is to provide the tubular mandrel mens 68 with an enlarged bore portion 121 and inner tube mandrel means 123. Both the enlarged bore portion 121 and the inner tube mandrel means 123 extend from one side of the packer means 52 to the other side. The inner tube mandrel means 123 is positioned within the enlarged bore portion 123 of the tubular mandrel means 68 and is attached thereto as by welding at its ends **123*a* and 123*b*. Then port 116 extends through the inner tube mandrel means 123 from the bore 70 to the annulus 118 between the inner tube mandrel means 123 of the tubular mandrel means 68 and the enlarged bore portion 121 of the tubular mandrel means 68. The first set of communicating means then includes the port 116, the annulus 118, and ports 122**.

The valve means 90 controls the communicating means. When the valve means 90 is in its initial position, as shown in FIG. 5B, it blocks the ports 116 and 122 so that drilling fluid can flow through the bore 70 of the mandrel means 68 but can ot flow through the communicating means. Shear pins 126 maintain the valve means 90 in its initial position. Valve means 90 has a port 128 to communicate with port 116 and a port 130 to communicate with port 122 which provide for crossover fluid flow when the valve means 90 is shifted to a second position.

FIG. 6 shows the actuator tool means 32, after having been transmitted downwardly through the drill string 26. It is positioned with its shoulder 131 engaging an upwardly facing shoulder 133 of the valve means 90.

The means for actuating the packer means 52 includes the actuator tool means 32. Preferably, so that one tool means is transmitted to the assembly 30 to both actuate the packer means 52 and control the valve assembly means, the tool 32 also becomes an actuator control tool means included within the valve assembly means and controls the valve assembly means to provide for controlled circulation by-passing the packer means 52.

Once the actuator control tool means 32 has engaged the sleeve valve means 90, continued application of fluid pressure in the drill string 26 results in the actuator control tool means 32 shearing pins 126 and shifting the valve means 90 downwardly to the position shown in FIG. 7. With the tool means 32 and the valve means 90 in this position, the packer means can be actuated and the crossover valve assembly means controlled.

The packer means is actuated by continuing to pump fluid down the drill string 26. The fluid flows through the now opened injection port 88, past the resilient annular check valve 92 and into the annulus 84 between the packer sleeve 76 and the tubular mandrel means 68. Continued injection of fluid into the annulus 84, expands the buttons 110 outwardly into gripping engagement with the wall of the well and inflates and expands the packer means 52, with the upper end **76*b* of the packer sleeve sliding along the member 68, until the packer element 74 provides a sealing engagement with the wall of the casing 24. While the packer means is being expanded, fluid is prevented from flowing around the tool means 32 through ports 130 and 122 into the annulus below the assembly 30 by seal means 132 around the tool means 32 which engages the valve means 90 above port 130**.

The valve assembly means illustrated in FIGS. 5, 6 and 7, is controlled to provide for crossover fluid circulation. As has been mentioned, when the valve means 90 is shifted to its second position, port 128 of the valve means 90 communicates with the port 116 of the first set of communicating means and port 130 of the valve means 90 communicates with port 122 of the second set of communicating means. The control tool means 32 controls the valve means 90 to provide the remaining passageway means that will establish crossover circulation.

To provide for crossover fluid circulation, in conjunction with the valve means 90 and the communicating means through the mandrel means 68, the control tool means 32 includes elongate body means 134, means for preventing fluid communication in a non-desired manner between two points, and passageway means through the body means 134. To prevent the undesirable fluid communication first and second seal means 136 and 138 are spaced along the body means 134. When the elongate body means is engaged with the valve means 90, the first and second spaced seal means 136 and 138 provide one seal area 140 of the body means 134 intermediate two end sections 142 and 144 of the body means 134. A first passageway means, including a port 146 and a blind bore 148 communicate between the exterior of said body means 134 at the one seal area 140 and one end section 142 of the body means 134. If the control tool means 32 merely engaged and controlled the valve assembly means the above elements of the control tool means 32 would enable the establishment of crossover fluid circulation. Fluid may circulate between the exterior of the drill string 26 above the packer means 52 and the interior of the drill string 26 at the packer means by flowing through the first communicating means of the tubular mandrel means 68, including port 120, annulus 118 and port 116; port 128 of the valve means 90; and the first passageway means of the control and means 32, including port 146 and blind bore 148. Fluid may also circulate between the exterior of the drill string 26 below the packer means 52 and the interior of the drill string 26 above the packer means 52 by flowing through the second communicating means of the tubular mandrel means including port 122; port 130 of the valve means; and port 160 of tool 32 to the interior of drill string 26 above the packer. To prevent back flow of fluid up the annulus above the packer means 52 a check valve means is disposed in the first passageway means. The check valve means includes a ball 152 in the blind bore 148 biased against seat 154 by spring 156. The first seal means 136 prevents fluid communication between the two crossover circulation patterns. The second seal means 138 cooperates with the check valve means to prevent backflow circulation between the interior of the drill string below the packer means 52 to the exterior of the drill string above the packer means 52.

Since the illustrated control tool means also functions as an actuating tool means for the packer means, it includes some additional elements. A third seal means 132 is disposed around the body means 134 spaced from the first 136 and second 138 seal means. Another seal area 158 is thus provided intermediate the two end sections 142 and 144. This third seal means 132 prevents fluid from flowing around the tool means 52 and into the annulus below the packer means 52 while the packer means is being expanded. With the third seal means 132, a second passageway means, including port 160 and blind bore 162, communicates between the exterior of the body means 134 at the other seal area 158 and the second end section 144 of the body means 134 to permit crossover circulation.

Means are disposed in said second passageway means that will selectively either block fluid flow through said second passageway means to permit inflation of the packer means, or permit fluid flow through said second passageway means when it is desired to provide for crossover circulation bypassing the expanded packer means 52. This means may be a frangible disc 164 disposed in the blind bore 162. The disc 164 will permit the packer means to be inflated to a predetermined pressure. It will then rupture permitting fluid flow through the second passageway means.

Preferably means are provided to releasably lock the actuator control tool means 32 within mandrel means 68 after it has actuated the packer means 52 and controlled the crossover valve assembly means. Any means may be provided which locks the actuator control tool means 32 against upward movement within the mandrel means 68. Due to the high formation pressures which may be encountered and which will act upwardly through the drill string 26 against the actuator control tool means 32, the locking means must be able to withstand a considerable pressure differential across the actuator control tool means 32.

The illustrated locking means is of a type which automatically locks when it enters a suitable recess. The locking means includes a carrier sleeve 166 slidably mounted around the upper end of the actuator control tool means. The carrier sleeve 166 carries at least one locking dog 168. When the actuator control tool means 32 is being run in the drill string 36, the carrier sleeve and locking dog 168 are held in an upper position around the tool by engagement with the drill string 26. (See FIG. 6) After the tool means 32 has engaged the valve means 90 and moved it downwardly, the carrier sleeve 166 and locking dogs 168 slide downwardly around the tool 32. During their downward movement the locking dogs 168 are expanded outwardly by a conical expander 170. In this expanded position the lower bosses 168*a* of the locking dogs 168 are engaged by a downward facing shoulder 172 within the tubular member 68. Such engagement locks the tool 32 within the mandrel means 68 against upward movement.

When a plurality of assemblies 30 are employed selector keys engageable within recesses in selected assemblies are employed instead of having the tool means 32 landing on shoulder 133. The use of selector keys and selector recesses to selectively locate a tool is taught in U.S. Pat. No. 2,673,614 to Miller which is incorporated herein by reference.

Figure 8:
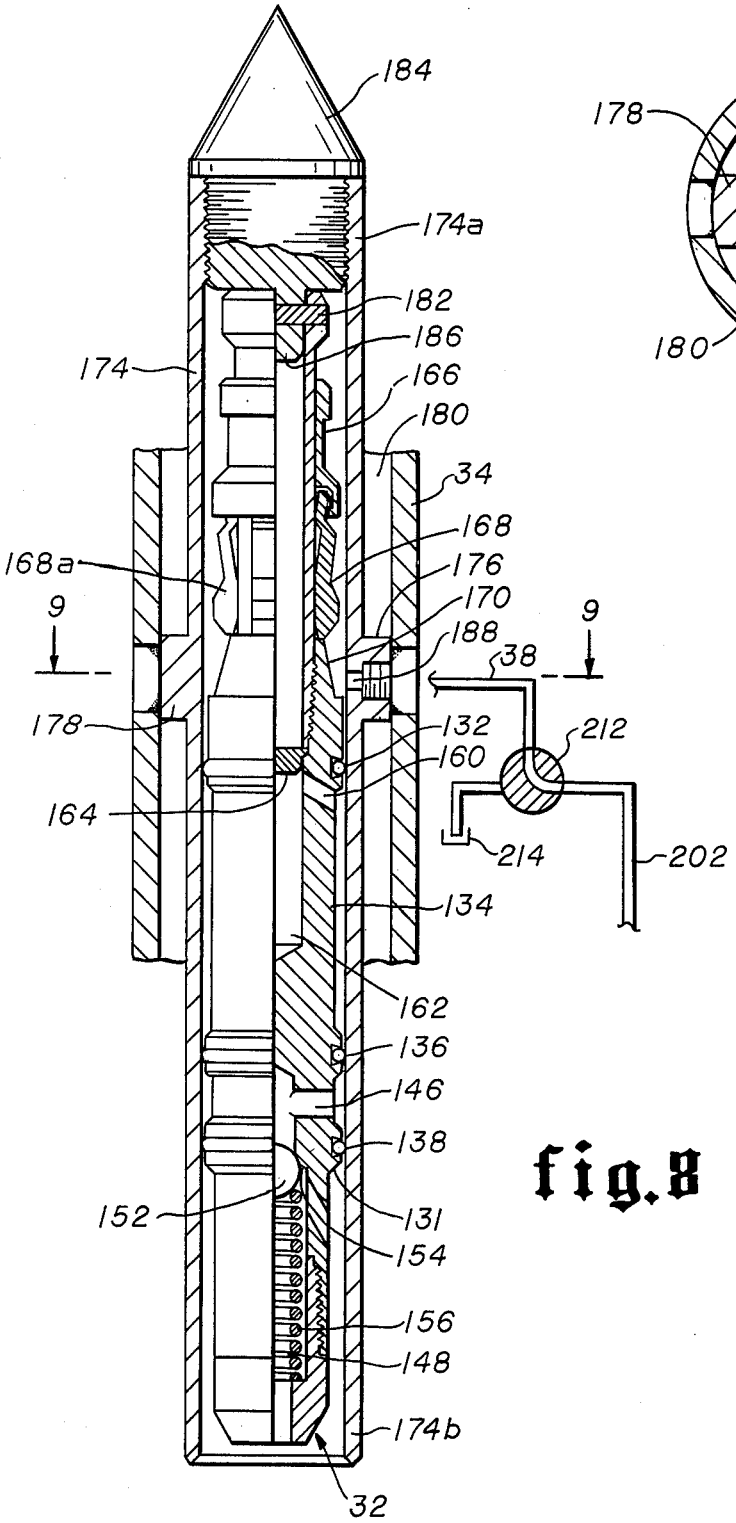
FIG. 8 is a view partly in section and partly in elevation showing a system for launching the tool of FIG. 6 into the drill string.
Figure 9:
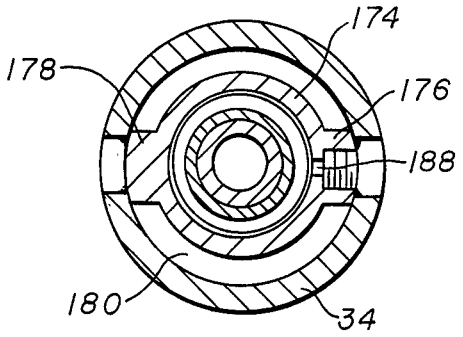
FIG. 9 is a view cross-sectional taken along line 9—9 of FIG. 8.

Any suitable system may be provided for launching the actuator control tool means 32 into the drill string 26 so that it may be transmitted downwardly through the drill string 26 to the assembly 30. Preferably the launching system enables the tool 32 to be launched into the drill string 26 quickly. One such launching system is shown in FIGS. 8 and 9.

The system for launching a tool into the stream of circulating drilling fluid comprises the bypass nipple tool launcher 34, a tool receiver 174, means for maintaining the tool 32 within the tool receiver 174, and a fluid ejection system.

The bypass nipple tool launcher 34 comprises a portion of the drill hose 36. It is thus a portion of the conduit means which confines the stream of circulating drilling fluid. As illustrated, the bypass nipple 34 may be positioned just upstream of the gooseneck 48. There it can be adequately supported. Additionally, such a location provides a launching system that does not require the alteration of the swivel joint 42.

To maintain the tool receiver 174 within the bypass nipple 34, it has two ears 176 and 178 which are welded to the bypass nipple 34. The circulating drilling fluid by passes the tool receiver by flowing in the annulus 180 between the tool receiver 174 and the bypass nipple 34. Preferably, the cross-sectional area of the annulus 180 is equal to or greater than the cross-sectional area of the drill hose 36. To enable a smooth flow of fluid around the tool receiver 174, the tool receiver 174 has a streamlined plug 182 threaded into its upstream end 174*a*.

The downstream end 174*b* of the tool receiver 174 is open so that the tool 32 may be ejected into the stream of flowing fluid.

Means are provided for releasably maintaining the tool 32 within the tool receiver 174. The releasable maintaining means illustrated is a shear pin 182 extending through the tool 32 and an extension 186 of the plug 184.

A fluid ejection system is formed in the annulus between the tool 32 and the tool receiver 174. The system is formed by having the plug 184 seal one end 174*a* of the tool receiver 174 and by having seal means 132, 136, and 138 positioned on the tool means 32 sealing the annulus between the tool means 32 and the tool receiver 174.

Means for pressurizing the ejection system is provided by having a passage 188 extend through the ear 176 and by having control line 38 communicate with the passage 188.

With the tool means 32 releasably maintained within the tool receiver 174 by the shear pin 182, the tool means 37 can be launched into the stream of flowing fluid at anytime. All that is required to launch the tool means 32 is the pressurizing of the fluid ejection system by injecting fluid into the annulus between the tool means 32 and the tool receiver 174 through control line 38. When the ejection system is sufficiently pressurized, the shear pin 182 will shear and the tool means 32 will be pushed downwardly until it exits through the lower end 174*b* of the tool receiver 174 into the stream of flowing fluid. The stream of fluid will then carry the tool means 32 downwardly to the assembly 30.

Figure 10:
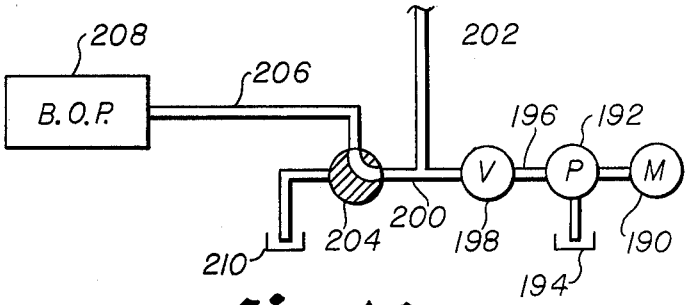
FIG. 10 is a schematic view of a control system for launching the tool from the launching system of FIG. 8.

A control circuity is shown in FIG. 10 and 8 for controlling the injection of fluid into the ejection system through control line 38. The control circuitry includes a motor, a pump, tanks, valves and conduits. The motor 190 drives pump 192. The pump 192 receives fluid from tank 194 and transmits the fluid under pressure into conduit 196. The pressure of the fluid is regulated by regulator valve 198. From the regulator valve 198 the fluid is transmitted through conduits 200 and 202 to the blowout preventers and the tool launcher 34, respectively.

A three-way valve 204 controls the pressurized fluid in conduit 200 to control the blowout preventer. When the valve 204 is in the position shown, it permits the pressurized fluid to flow through the valve and through conduit 206 to the blowout preventers 208 to actuate them. When the valve 204 is rotated 90° counterclockwise from the position shown, the pressurized fluid can not flow through the valve and the blowout preventers 208 can bleed off into tank 210. With this form of control circuitry, the blowout preventers 208 are powered toward a closed position.

Three-way valve 212 controls conduit 202 (See FIGS. 8 and 10). When the valve 212 is in the position shown, fluid can flow through the valve 212 and into control line 38 to pressurize the fluid ejection system. Once the tool 32 has been launched the valve 212 is rotated 90° counterclockwise from the illustrated position. This rotation prevents the escape of the pressurized fluid from the pump through the bypass nipple 34. The rotation also permits any fluid that may bleed back through line 38 from the bypass nipple 34 to bleed into tank 214.

Normally, valve 212 is positioned so that the pressurized fluid cannot be transmitted to the ejection system and so that the ejection system is continuously open to the tank 214. Thus, pressure cannot build up in the ejection system (as by leakage) and accidentally launch the tool 32.

It can be seen that by the use of such a control circuitry, the conduit 202 is constantly pressurized. The only action that need be taken to launch the tool 32 into the stream of circulating drilling fluid is the turning of valve 212. Valve 212 may be positioned at any convenient location, such as near the well operator on the drilling platform. The well operator may then launch the tool 32 into the stream of circulating drilling fluid and have it carried downwardly to activate an assembly 30 of this invention.

It can be seen then that this invention provides a method of controlling an abnormally high pressure formation by actuating a packer means and controlling the drilling fluid circulation in the vicinity of said packer means.

FIG. 11 shows schematically a still further embodiment of this invention that will provide for sealing the annulus around a drill string and establishing controlled circulation by-passing the annulus sealing packer means 52. In this embodiment, the packer means 52 is carried by tubular mandrel means 216. Communicating means, 218 in a wall of the mandrel means 216 are provided which terminate at the exterior wall of the mandrel means 216. Means are provided for actuating the packer means 52 and rendering the by-passing communicating means 218 operative. As illustrated the packer means 52 can be actuated by injecting fluid through port 220. The port 220 is normally closed by a sleeve valve means 222. The sleeve valve means 222 is moved to a port opening position by an actuating tool means 224. The actuating tool has means, such as check valve 226, for selectively blocking fluid flow through the tool means 224 while the packer means 52 is being inflated or permiting controlled circulation through the tool means 224 and up the drill string above the actuated packer means 52. After the packer means 52 has been actuated, reverse circulation will render the by-pass communicating means 218 operative. Preferably a backcheck valve means 228 is provided in the communicating means 218 to prevent backflow of fluid into the annulus above the packer means 52.

It can be seen from the foregoing that a novel method and apparatus for controlling a well during drilling operations has been provided.

The packer means 52 is a downhole packer and seals the annulus around the drill string 26. The assembly 30 is positioned within the drill string 26 so that the actuated packer means can provide an effective seal. Preferably the assembly 30 is within the casing 24. However, it is within the scope of this invention to have an open hole packer means. The packer means would then seal against the well wall. In soft formations is sometimes difficult to create an effective seal with an openhole packer. If the operator senses that he has not created an effective seal with the openhole packer means, he can lift the drill string 26 until the packer means 52 contacts a solid formation and creates an effective seal.

The valve assembly means or communicating means permits continued circulation of the drilling fluid below the packer means. With the continued circulation below the packer means, the packer means and the control assembly does not have to be positioned directly above the drill bit. It can be positioned at any desired location within the drill string, preferably, where the actuated packer means will provide an effective seal.

The valve assembly means also confines the high pressure of the formation to the interior of the drill string 26 above the packer means 52. The drill string 26 is better adapted to withstanding high pressures than is the casing 24 or the well head equipment. Additionally, once the high pressure is transmitted up the drill string 26, it can be controlled by the safety equipment of safety valves such as valve 50 associated with the drill string 26.

Once the valve assembly means is controlled to provide for controlled fluid flow by-passing the packer means, the drilling fluid circulation is reversed. Up to this time drilling fluid circulation is flowing in a parallel pattern downwardly through the drill string and upwardly exterior of the drill string. Preferably controlled crossover circulation is provided so that upon reversing the circulation, fluid flows downwardly exterior of the drill string until it crosses over through the valve assembly means and continues flowing downwardly through the drill string below the packer means. The drilling fluid then flows out through the drill bit and upwardly exterior of the drill string until it again reaches the valve assembly means. It is again crossed over and continues flowing upwardly through the interior of the drill string above the packer means.

The check valve means of the crossover valve assembly means or communicating means is provided as a safety device. The check valve means prevents any high pressures associated with the formation from flowing to the exterior of the drill string above the packer means and in effect bypassing the packer means when fluid is not being pumped into the well.

The actuator control tool illustrated both provides the means for actuating the packer means and for controlling the crossover valve assembly means. Instead of utilizing one tool, two tools could be utilized, an actuating tool means to actuate the packer means and a control tool means to control the crossover valve assembly means.

While in its position controlling the valve assembly means so that there is continued fluid flow, the actuator control tool means, as illustrated in FIGS. 3, 4, 6 and 7, forms a portion of the valve assembly means. Other valve assembly means could be provided, as illustrated in FIG. 11, where the control tool did not form a portion of the valve assembly means.

The bypass nipple tool launcher provides a means for quickly injecting the actuator control tool into the string of flowing drilling fluid. Other means obvious to those skilled in the art could also be provided.

It can be seen from the foregoing that the objects of this invention have been obtained. A method and apparatus for controlling an abnormally high pressure formation in a well have been provided.

The method contemplates continued circulation below a downhole packer means. The packer means may thus be positioned within the drill string so that it seals against the casing of the well rather than against the open bore of the well. However openhole packers may also be utilized.

Through the utilization of both the method and apparatus of this invention high pressures in a well are transferred from the annulus exterior of the drill string and confined to the interior of the drill string where they may be more safely and effectively controlled.

The foregoing disclosure and description of the invention are illustrative and explanatory thereof and various changes in the size, shape of materials, as well as in the details of the illustrative construction and processes may be made within the scope of the appended claims without departing from the spirit of the invention.

What is claimed is:

1. A combination for use in a downhole blowout preventer system while drilling a well, the combination comprising:

one structure adapted to be located downhole in a well including:

tubular mandrel means adapted to be located in a well drill string, packer means carried by said mandrel means, and communicating means at least in part in a wall of said mandrel means by-passing said packer means and terminating at the exterior wall of said mandrel means; and a second structure adapted to be pumpable down a drill string to said one structure including:

means for actuating said packer means and rendering said by-passing communicating means operative.

2. A combination for use in a downhole blowout preventer system while drilling a well, the combination comprising:

one structure adapted to be located downhole in a well including:

tubular mandrel means adapted to be located in a well drill string, packer means carried by said mandrel means, communicating means through the wall of said mandrel means having exterior port means on opposite sides of said packer means, and valve assembly means including (i) valve means controlling said communicating means and (ii) means in the mandrel means for moving said valve means from an initial position closing said communicating means to a position wherein said valve assembly means provides for controlled flow of fluid in through said mandrel means and said communicating means by-passing said packer means; and a second structure adapted to be pumpable down a drill string to said one structure including:

means for actuating said packer means.

3. The combination of claim 2 wherein said valve assembly means includes means for preventing fluid circulation flowing to the exterior of said mandrel means above said packer means.

4. The combination of claim 2 wherein said mandrel means is adapted to be located within a well casing so that said packer means, when actuated, will seal an annulus between a drill string and a well casing.

5. The combination of claim 2 wherein the controlled fluid circulation is crossover fluid circulation flowing from the exterior port means above said packer means to the bore of the said mandrel means below said packer means and flowing from the exterior port means below said packer means to the bore of said mandrel means above said packer means.

6. The combination of claim 2 wherein said second structure additionally functions as said means for moving said valve means.

7. The combination of claim 2 wherein said second structure comprises:

elongated body means;

first and second seal means spaced along said body means for providing one seal area intermediate two end sections of said body means;

first passageway means for communicating between the exterior of said body means at said one seal area and one end section of said body means; and check valve means disposed in said first passageway means.

8. The combination of claim 7 wherein said second structure additionally includes:

shoulder means on said body means for engaging stop means in a well pipe.

9. The combination of claim 2 wherein said second structure comprises:

elongated body means;

first, second and third seal means spaced along said body means for providing two seal areas intermediate two end sections of said body means;

first passageway means for communicating between the exterior of said body means at one seal area and one end section of said body means;

check valve means disposed in said first passageway means; and second passageway means for communicating between the exterior of said body means at the other seal area and the other end section of said body means.

10. The combination of claim 9 wherein said second structure additionally includes:

shoulder means on said body means for engaging stop means in a well pipe.

11. The combination of claim 9 wherein said second structure additionally includes:

means in said second passageway means for selectively preventing fluid flow through said second passageway means and permitting fluid flow through said second passageway means.

12. A combination for use in a downhole blowout preventer system while drilling a well, the combination comprising:

one structure adapted to be located downhole in a well and including:

tubular mandrel means adapted to be located in a well drill string, packer means carried by said mandrel means, communicating means through the wall of said mandrel means and having exterior ports on opposite sides of said packer means, and valve means for controlling said communicating means and movable between an initial position closing said communicating means and a position opening said communicating means, and at least one second structure adapted to be pumpable down a drill string to said one structure and including:

means to actuate said packer means, and means to control said valve means.

13. The combination of claim 12 wherein said mandrel means is adapted to be located within a well casing so that said packer means, when actuated, will seal the annulus between a drill string and a well casing.

14. The combination of claim 12 wherein said second structure comprises:

elongated body means;

first and second seal means spaced along said body means for providing one seal area intermediate two end sections of said body means;

first passageway means for communicating between the exterior of said body means at said one seal area and one end section of said body means; and check valve means disposed in said first passageway means.

15. The combination of claim 14 wherein said second structure additionally includes:

shoulder means on said body means for engaging stop means in a well pipe.

16. The combination of claim 12 wherein said second structure comprises:

elongated body means;

first, second and third seal means spaced along said body means for providing two seal areas intermediate two end sections of said body means;

first passageway means for communicating between the exterior of said body means at one seal area and one end section of said body means;

check valve means disposed in said first passageway means; and second passageway means for communicating between the exterior of said body means at the other seal area and the other end section of said body means.

17. The combination of claim 16 wherein said second structure additionally includes:

shoulder means on said body means for engaging stop means in a well pipe.

18. The combination of claim 16 wherein said second structure additionally includes:

means in said second passageway means for selectively preventing fluid flow through said second passageway means and permitting fluid flow through said second passageway means.

19. The combination of claim 16 additionally including:

stop nipple means associated with, said one structure; and selector stop means associated with said second structure cooperable with a selected stop nipple means to stop movement of said second structure;

with a plurality of said one structures being adapted to be located downhole in a well in spaced relationship and a selected second structure being adapted to be pumpable down the well to engage a selected one of said one structures.

20. A combination for use in downhole blowout preventer system while drilling a well, the combination comprising:

one structure adapted to be located downhole in a well and including:

tubular mandrel means adapted to be located in a well drill string, packer means carried by said mandrel means, communicating means through the wall of said mandrel means and having exterior port means on opposite sides of said packer means, and valve assembly means including valve means for controlling said communicating means and initially in a position closing said communicating means; and a second structure adapted to be pumpable down a drill string to said one structure and including:

elongate body means, first, second and third seal means spaced along said body means for providing two seal areas intermediate two end sections of said body means, first passageway means communicating between the exterior of said body means at one seal area and one end section of said body means, check valve means disposed in said first passageway means, and second passageway means for communicating between the exterior of said body means at the other seal area and the other end section of said body means.

21. The combination of claim 20 wherein said second structure includes means for preventing fluid circulation flowing to the exterior of said mandrel means above said packer means.

22. The combination of claim 20 wherein said mandrel means is adapted to be located within a well casing so that said packer means, when actuated, with seal an annulus between a drill string and a well casing.

23. The combination of claim 20 wherein when said valve means is moved from said initial position to a second position the fluid circulation through said communicating means is cross-over fluid circulation flowing from the exterior port means above said packer means to the bore of said mandrel means below said packer means and flowing from the exterior port means below said packer means to the bore of said mandrel means above said packer means.

24. The downhole blowout preventer system of claim 20 wherein said second structure functions as a means for actuating said packer means.

25. The combination of claim 20 wherein said second structure additionally includes shoulder means on said body means for engaging stop means in a tubing.

26. The combination of claim 20 additionally including:

stop nipple means associated with, said one structure; and selector stop means associated with said second structure cooperable with a selected stop nipple means to stop movement of said second structure;

with a plurality of said one structures being adapted to be located downhole in a well in spaced relationship and a selected second structure being adapted to be pumpable down the well to engage a selected one of said one structures.

* * * * *

UNITED STATES PATENT OFFICE

CERTIFICATE OF CORRECTION

Patent No. 4,108,257 Dated August 22, 1978

Inventor(s) Phillip S. Sizer

It is certified that error appears in the above-identified patent and that said Letters Patent are hereby corrected as shown below:

Column 6, line 20, "alterantive" should read "alternative"

Column 7, line 35, "annuluar" should read "annular"

Column 7, line 59, "Preferbly" should read "Preferably"

Column 8, line 56, "can ot" should read "cannot"

Column 12, line 11, "circuity" should read "circuitry"

Column 13, line 33, "In soft formations is sometimes" should read "In soft formations it is sometimes"

Signed and Sealed this

*Eighth* Day of *May 1979*

[SEAL]

*Attest:*

RUTH C. MASON
*Attesting Officer*

DONALD W. BANNER
*Commissioner of Patents and Trademarks*